US010957466B1

(12) United States Patent
Kojima

(10) Patent No.: US 10,957,466 B1
(45) Date of Patent: Mar. 23, 2021

(54) SHIELDED FLAT CABLE

(71) Applicant: SUMITOMO ELECTRIC INDUSTRIES, LTD., Osaka (JP)

(72) Inventor: Chiaki Kojima, Tochigi (JP)

(73) Assignee: SUMITOMO ELECTRIC INDUSTRIES, LTD, Osaka (JP)

( * ) Notice: Subject to any disclaimer, the term of this patent is extended or adjusted under 35 U.S.C. 154(b) by 0 days.

(21) Appl. No.: 16/987,570

(22) Filed: Aug. 7, 2020

(30) Foreign Application Priority Data

Aug. 28, 2019 (JP) ..... JP2019-155423

(51) Int. Cl.
*H01B 7/08* (2006.01)
*H01B 7/00* (2006.01)

(52) U.S. Cl.
CPC ..... *H01B 7/0838* (2013.01); *H01B 7/0009* (2013.01); *H01B 7/0861* (2013.01)

(58) Field of Classification Search
CPC ... H01B 7/0838; H01B 7/0009; H01B 7/0861
USPC ..... 174/102 R
See application file for complete search history.

(56) References Cited

U.S. PATENT DOCUMENTS 3,634,782 A * 1/1972 Marshall ..... H01B 7/0861 333/1
3,775,552 A * 11/1973 Schumacher ..... H01B 11/203 174/105 R
4,185,162 A * 1/1980 Bogese, II ..... H01B 7/0838 174/115
4,287,385 A * 9/1981 Dombrowsky ..... H01B 7/0861 174/105 R
4,415,216 A * 11/1983 Narozny ..... H01R 12/775 439/465
4,475,006 A * 10/1984 Olyphant, Jr. ..... H01B 7/0861 174/102 R
4,899,236 A * 2/1990 Edakubo ..... G11B 15/08 360/85
5,360,944 A * 11/1994 Springer ..... H01B 7/0838 174/102 R
5,455,383 A 10/1995 Tanaka
6,977,344 B2 * 12/2005 Tanaka ..... H01B 7/0861 174/117 F
7,868,254 B2 * 1/2011 Matsushita ..... H01B 7/0861 174/117 FF (Continued)

FOREIGN PATENT DOCUMENTS

JP H06-283053 10/1994

*Primary Examiner* — Timothy J Thompson
*Assistant Examiner* — Michael F McAllister
(74) *Attorney, Agent, or Firm* — IPUSA, PLLC

(57) ABSTRACT

A shielded flat cable includes one or more ground wires arranged, the ground wires being parallel to each other, one or more signal wires arranged parallel to the one or more ground wires, an insulating layer covering the one or more ground wires and the one or more signal wires, and a shield layer provided on an outer surface of the insulating layer, wherein a thickness of the insulating layer at a central position of each ground wire in an arrangement direction is smaller than a thickness of the insulating layer at a central position of each signal wire in the arrangement direction, in a cross-section orthogonal to a longitudinal direction of the one or more ground wires, the arrangement direction being a direction in which the one or more ground wires and the one or more signal wires are arranged parallel to each other.

5 Claims, 7 Drawing Sheets

(56) References Cited

U.S. PATENT DOCUMENTS

| | | | | |
|---|---|---|---|---|
| 8,067,693 | B2 * | 11/2011 | Sun | H01B 11/04 174/117 F |
| 9,672,957 | B2 * | 6/2017 | Kordecki | H01B 11/1891 |
| 9,881,717 | B2 * | 1/2018 | Chen | H01R 13/665 |
| 2003/0085052 | A1 * | 5/2003 | Tsao | H01B 7/0861 174/113 R |
| 2004/0011553 | A1 * | 1/2004 | Cianciolo | H01B 7/0838 174/117 FF |
| 2012/0285723 | A1 * | 11/2012 | Gundel | H01B 11/1869 174/113 R |
| 2018/0166814 | A1 * | 6/2018 | Chin | H01B 7/0861 |

* cited by examiner

SHIELDED FLAT CABLE

CROSS-REFERENCE TO RELATED APPLICATIONS

This application is based upon and claims priority to Japanese Patent Application No. 2019-155423 filed on Aug. 28, 2019, the entire contents of which are incorporated herein by reference.

BACKGROUND OF THE INVENTION

1. Field of the Invention

The present disclosure relates to a shielded flat cable.

2. Description of the Related Art

Flexible flat cables (FFCs) are used for space saving and easy connections in many fields including audio visual equipment, such as CD and DVD players, office automation equipment, such as copiers and printers, and internal wiring of other electronic and information equipment. Here, the higher frequency the equipment uses, the greater an influence of noise is. Thus, shielded flat cables are used.

A shield of the shielded flat cable is achieved, for example, by providing a shield layer outside the FFC. As disclosed in Patent Document 1, for example, the shield layer that is electronically connected to a ground wire through an opening provided on one side of the ground wire of the shielded flat cable and that is maintained at the ground potential of a substrate side through the ground wire, has been known.

Each conductor surrounded by the shielded layer is not easily influenced by noise from the outside of the cable and can achieve high-speed signal transmission because each conductor does not adversely affect the outside of the cable, such as generating noise. However, crosstalk occurs between conductors surrounded by the shield layer. The shielded flat cable disclosed in Patent Document 1 is required to have continuous or partial exposure of the ground wire.

It is desired to provide a shielded flat cable that is not easily influenced by external noise and crosstalk in a simple configuration.

RELATED-ART DOCUMENTS

PATENT DOCUMENTS

Patent Document 1: Japanese Laid-Open Patent Publication No. 6-283053

SUMMARY OF THE INVENTION

According to one aspect of the embodiments of the present disclosure, a shielded flat cable includes one or more ground wires arranged, the ground wires being parallel to each other, one or more signal wires arranged parallel to the one or more ground wires, an insulating layer covering the one or more ground wires and the one or more signal wires, and a shield layer provided on an outer surface of the insulating layer, wherein a thickness of the insulating layer at a central position of each ground wire in an arrangement direction is smaller than a thickness of the insulating layer at a central position of each signal wire in the arrangement direction, in a cross-section orthogonal to a longitudinal direction of the one or more ground wires, the arrangement direction being a direction in which the one or more ground wires and the one or more signal wires are arranged parallel to each other.

According to at least one embodiment of the present disclosure, a shielded flat cable that is not easily influenced by external noise and crosstalk can be obtained.

DESCRIPTION OF THE EMBODIMENTS

Figure 1:
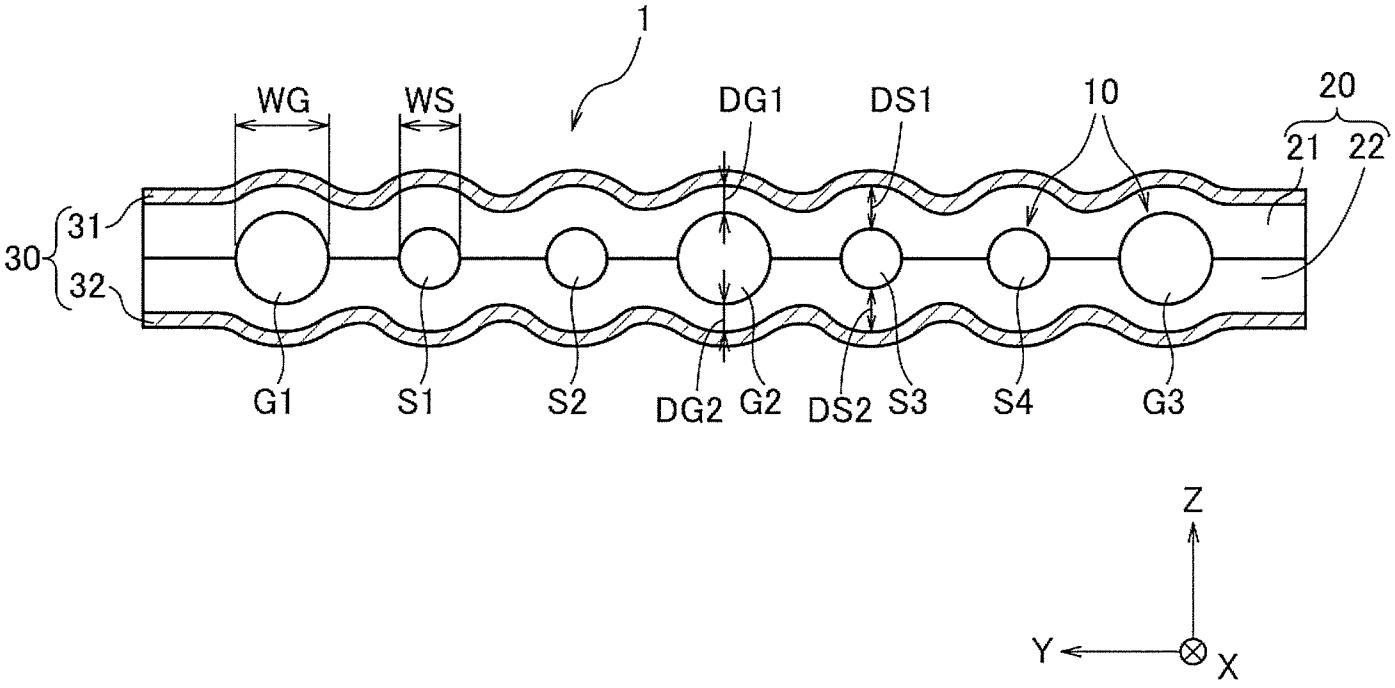
FIG. 1 is a cross-sectional view orthogonal to a longitudinal direction, illustrating an overview of a shielded flat cable according to a first embodiment of the present disclosure.

Description of Embodiments of the Present Disclosure

First, embodiments of the present disclosure will be described by listing.

(1) A shielded flat cable according to one aspect of the present disclosure includes one or more ground wires, the ground wires being parallel to each other, one or more signal wires arranged parallel to the one or more ground wires, an insulating layer covering the one or more ground wires and the one or more signal wires, and a shield layer provided on an outer surface of the insulating layer, wherein a thickness of the insulating layer at a central position of each ground wire in an arrangement direction is smaller than a thickness of the insulating layer at a central position of each signal wire in the arrangement direction, in a cross-section orthogonal to a longitudinal direction of the one or more ground wires, the arrangement direction being a direction in which the one or more ground wires and the one or more signal wires are arranged parallel to each other.

With this configuration, the signal wire can be surrounded by the ground wire and the shield layer, so that the signal wire can be shielded with certainty and is not easily influenced by external noise and crosstalk.

(2) In the cross-section orthogonal to the longitudinal direction of the one or more ground wires, a thickness of the one or more ground wires in a direction orthogonal to the arrangement direction may be greater than a thickness of the one or more signal wires in a direction orthogonal to the arrangement direction. This configuration can easily cause a thickness of the insulating layer at the center position of each ground wire in the arrangement direction to be smaller than a thickness of the insulating layer at a center position of each signal wire in the arrangement direction, in the cross-section orthogonal to the longitudinal direction of the shielded flat cable.

(3) In the cross-section orthogonal to the longitudinal direction of the one or more ground wires, a width of the one or more ground wires in the arrangement direction may be greater than a width of the one or more signal wires in the arrangement direction.

This configuration can increase a facing area between the one or more ground wires and the shielding layer, so that the one or more signal wires can be shielded with certainty and cannot be easily influenced by external noise and crosstalk.

Details of Embodiments of the Present Disclosure

In the following, preferred embodiments of the shielded flat cable of the present disclosure will be described with reference to the drawings. In the following description, configurations referenced by the same reference numerals are assumed to be similar even in different drawings, and a description may be omitted. It should be noted that the present invention is not limited to these embodiments, and includes all modifications within the scope of the descriptions of the claims and equivalents. The present invention also includes a combination of any embodiments as long as multiple embodiments can be combined.

First Embodiment

FIG. 1 is a cross-sectional view orthogonal to a longitudinal direction, illustrating an overview of a shielded flat cable according to a first embodiment of the present disclosure. A shielded flat cable 1 according to the present embodiment includes multiple conductors 10 arranged side by side parallel to each other, a first insulating layer 21 and a second insulating layer 22 that cover the conductors 10, a first shield layer 31 covering an external surface of the first insulating layer 21, and a second shield layer 32 covering an external surface of the second insulating layer 22. The surfaces of the first insulating layer 21 and the second insulating layer 22 are changed to form wave shapes, and similarly, the surfaces of the first shield layer 31 and the second shield layer 32 are changed to form wave shapes. In the present disclosure, with respect to an X-axis, a Y-axis, and a Z-axis illustrated in FIG. 1, it is assumed that the X-axis represents a longitudinal direction of the conductor 10, the Y-axis represents an arrangement direction of the multiple conductors 10, and the Z-axis represents a thickness or height direction of the shielded flat cable 1. The axes are similar in other embodiments.

The conductors 10 are arranged side by side so that one ground wire G and two signal wires S are repeated in the arrangement direction (i.e., the Y-axis direction), such as G-S-S-G-S-S-G-S-S-G . . . when a signal wire is S and a ground wire is G. In the present embodiment, signal wires S1 and S2 are arranged side by side between two ground wires G1 and G2, and two signal wires S3 and S4 are arranged side by side between two ground wires G2 and G3. In this case, two adjacent signal wires S1 and S2 and two adjacent signal wires S3 and S4 are used for differential transmission. In addition to the above arrangement, two signal wires S and two ground wires G may be repeatedly arranged, such as G1-G2-S1-S2-G3-G4-S3-S4-G5-G6-S5-S6-G7-G8. Further, when differential transmission is not performed, one signal wire S may be arranged between ground wires G.

In the present embodiment, the conductor 10 is a small diameter electric wire made of a conductive metal such as copper foil and tin-plated soft copper foil, and the thickness of the ground wires G1 to G3 is greater than the thickness of the signal wires S1 to S4. For example, in the shielded flat cable 1, American Wire Gauge (AWG) No. 32 (a diameter is 0.2019 mm and a cross-sectional area is 0.03203 $mm^2$) may be used as the ground wires G1 to G3, and AWG No. 34 (a diameter is 0.1601 mm and a cross-sectional area is 0.0214 $mm^2$) may be used as the signal wires S1 to S4. The conductors 10, which are the ground wires G1 to G3 and the signal wires S1 to S4, are arranged side by side with pitches of a suitable length from about 0.4 to 2.0 mm.

The first and second insulating layers 21 and 22 each include a resin film and an adhesive layer (which is not illustrated), and are formed by bonding resin films with adhesive layers on inner surfaces (i.e., bonding surfaces) of the insulating layers. A general resin film having excellent flexibility is used for the first and second insulating layers 21 and 22 themselves. For example, a versatile resin film, such as a polyester resin, a polyphenylene sulfide resin, and a polyimide resin, may be used. The thickness of the resin film used is from 9 μm to 100 μm. The polyester resin may include a resin material such as a polyethylene terephthalate resin, a polyethylene naphthalate resin, and a polybutylene naphthalate resin.

The adhesive layers of the first insulating layer 21 and the second insulating layer 22 are made of a resin material, and include, for example, an adhesive made by adding a flame retardant to a polyester-based resin or a polyolefin-based resin. The adhesive layer is formed with a suitable thickness from 10 μm to 150 μm. The first insulating layer 21 and the second insulating layer 22 are bonded together and combined by causing the adhesive layers to face each other with sandwiching the conductors 10, and causing the adhesive layers to be joined by applying heat by heating rollers. The first insulating layer 21 and the second insulating layer 22 may be formed of a single layer resin such as polyethylene, polypropylene, polyimide, polyethylene terephthalate, polyester, or polyphenylene sulfide, without using the adhesive layer, for example. In this case, the thickness of the resin may be, for example, about 400 μm.

The thickness of the first shield layer 31 and the second shield layer 32 are from about 10 to 200 μm and are formed using a film with a two-layer structure of a metal layer and an adhesive layer (which is not illustrated). The metal layers of the first shield layer 31 and the second shield layer 32 can be, for example, a metal foil or a metal deposition film formed on an insulating film. The metallic materials of the first shield layer 31 and the second shield layer 32 are preferably copper or aluminum having relatively low cost and excellent electrical conductivity. When the thickness of the first shield layer 31 and the second shield layer 32 is too thin, an electrical resistance of the shield layer increases, thereby reducing a shielding effect. When the thickness of the first shield layer 31 and the second shield layer 32 is thick, the flexibility of the shielded flat cable 1 is impaired while the shielding effect can be obtained. Therefore, the thickness of the first shield layer 31 and the second shield layer 32 may be selected depending on a use situation. The first shield layer 31 and the second shield layer 32 are respectively attached to the first insulating layer 21 and the second insulating layer 22 with the adhesive layers inside.

In the present embodiment, the thickness of the ground wires G1 to G3 is greater than the thickness of the signal wires S1 to S4. As illustrated in FIG. 1, in the cross-section orthogonal to the longitudinal direction, with respect to the thickness of the first insulating layer 21, thickness DG1 at a central position of each of the ground wires G1 to G3 in the arrangement direction (i.e., the Y-axis direction) is smaller than thickness DS1 of a central position of each of the signal wires S1 to S4 in the arrangement direction. With respect to the thickness of the second insulating layer 22, thickness DG2 at the central position of each of the ground wires G1 to G3 in the arrangement direction is smaller than thickness DS2 at the central position of each of the signal wires S1 to S4 in the arrangement direction. Since the thickness of the ground wires G1 to G3 is greater than the thickness of the signal wires S1 to S4, a width WG in the arrangement direction in which each of the ground wires G1 to G3 is opposite each of the first and second shield layers 31 and 32, is greater than a width WS in the arrangement direction in which each of the signal wires S1 to S4 is opposite each of the first and second shield layers 31 and 32.

This configuration reduces the capacitance between the ground wires G1 to G3 and the first and second shield layers 31 and 32, and reduces the reactance to high frequency noise between the ground wires G1 to G3 and the first and second shield layers 31 and 32. Thus, for example, a pair of the signal wires S1 and S2 is surrounded and shielded against high frequency noise by the ground wire G1, the first shield layer 31, the ground wire G2, and the second shield layer 32. Therefore, the ground wires G1 and G2 function as shields to block noise from a direction parallel to the signal wires S1 and S2.

Manufacturing Method

Figure 2:
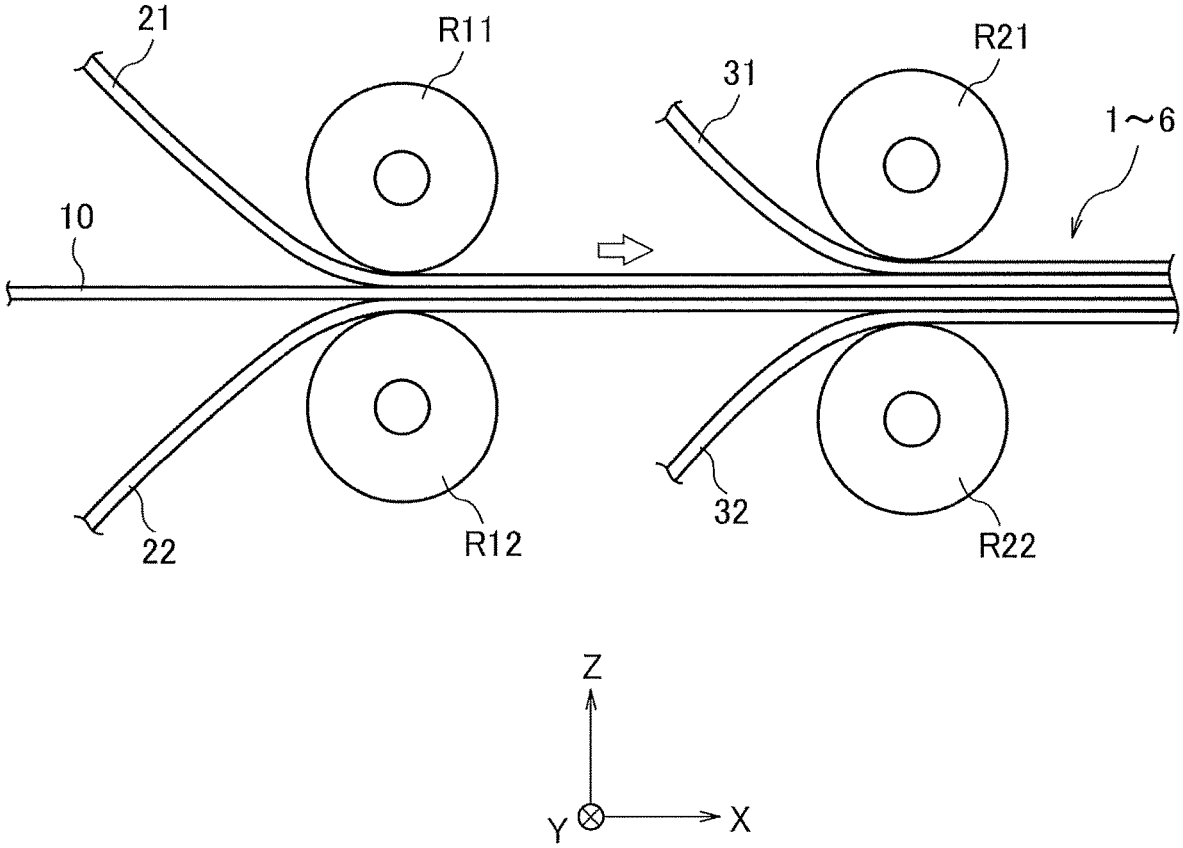
FIG. 2 is a drawing for describing an example of a manufacturing process of a shielded flat cable according to an embodiment of the present disclosure.

Next, an example of a method for manufacturing the shielded flat cable according to the present embodiment will be described. FIG. 2 is a drawing for describing an example of a manufacturing process of the shielded flat cable according to the embodiment of the present disclosure, and illustrates an example in which a heating roll is used as a method for manufacturing the shielded flat cable. For easy understanding of a laminated relationship of each member constituting the shielded flat cable, FIG. 2 illustrates each member with a thickness different from the actual thickness of each member.

The shielded flat cable 1 according to the present embodiment is obtained by pressing the first insulating layer 21, the multiple conductors 10 arranged side by side parallel to each other, and the second insulating layer 22 by the heating roller and the bonding the first insulating layer 21, the multiple conductors 10, and the second insulating layer 22 together. A manufacturing device includes a pair of heating rollers R11 and R12 for forming insulating layers and a pair of heating rollers R21 and R22 for forming shield layers at a subsequent stage of the heating rollers R11 and R12. First, the multiple conductors 10 arranged side by side parallel to each other, are provided between a pair of heating rollers R11 and R12, the first insulating layer 21 coupled to a supporting film (not illustrated) is provided on a front side of the conductor 10 (i.e., a plus side in the Z-axis direction), and the second insulating layer 22 coupled to a support tape (also not illustrated) is provided to a back surface of the conductor 10 (i.e., a minus side in the Z-axis direction).

Here, with respect to the multiple conductors 10, as described above, the ground wires G1 to G3 and the signal wires S1 to S4 are arranged parallel to each other with predetermined arrangements and intervals. When the first insulating layer 21 and the second insulating layer 22 have adhesive layers, the first insulating layer 21 and the second insulating layer 22 are provided between the first and second heating rollers R11 and R12 at the first stage such that the adhesive layers face each other. In a bonding step, the conductors 10 are sandwiched between the first insulating layer 21 and the second insulating layer 22, and the first insulating layer 21 and the second insulating layer 22 are bonded together to manufacture a long flat cable.

Next, the front side and the back side of the flat cable transferred from the heating rollers R11 and R12 at the first stage are sandwiched between the first shield layer 31 and the second shield layer 32, and provided between the heating rollers R21 and R22 at the second stage. In this case, the first shield layer 31 and the second shield layer 32 are disposed so that the adhesive layers provided on the first shield layer 31 and the second shield layer 32 face each other. Then, the first shield layer 31 and the second shield layer 32 are bonded to the respective surfaces of the first insulating layer 21 and the second insulating layer 22 to obtain the shielded flat cable 1.

In the present embodiment, rubber rollers having cylindrical surfaces are used as the heating rollers R11 and R12 at the first stage and the heating rollers R21 and R22 at the second stage. Thus, the surfaces of the heating rollers R11, R12, R21, and R22 can be deformed. When the conductors 10 are sandwiched between the first insulating layer 21 and the second insulating layer 22, and the first insulating layer 21 and the second insulating layer 22 are bonded to the conductors 10, forces exerted on positions of the first insulating layer 21 and the second insulating layer 22 at the thick ground wires G1 to G3 are great than forces exerted on positions of the first insulating layer 21 and the second insulating layer 22 at the thin signal wires S1 to S4. Thus, as illustrated in FIG. 1, with respect to the thickness of the first insulating layer 21, the thickness DG1 at the central position of each of the ground wires G1 to G3 in the arrangement direction becomes smaller than the thickness DS1 at the central position of each of the signal wires S1 to S4 in the arrangement direction. With respect to the thickness of the second insulating layer 22, the thickness DG2 at the central position of each of the ground wires G1 to G3 in the arrangement direction becomes smaller than the thickness DS2 at the central position of each of the signal wires S1 to S4 in the arrangement direction. The surfaces of the first insulating layer 21 and the second insulating layer 22 are changed to form wave shapes in accordance with positions of the conductors 10.

If the hardness of the heating rollers R11 and R12 is the same, the thickness DG1 of the first insulating layer 21 at the central position of each of the ground wires G1 to G3 in the arrangement direction is substantially equal to the thickness DG2 of the second insulating layer 22 at the central position of each of the ground wires G1 to G3 in the arrangement direction, and the thickness DS1 of the first insulating layer 21 at the central position of each of the signal wires S1 to S4 in the arrangement direction is substantially equal to the thickness DS2 of the second insulating layer 22 at the central position of each of the signal wires S1 to S4 in the arrangement direction. Therefore, in the present embodiment, in the cross-section orthogonal to the longitudinal direction, the thickness of the first and second insulating layers 21 and 22 at the central position of each of the ground wires G1 to G3 in the arrangement direction is smaller than the thickness of the first and second insulating layers 21 and 22 at the central position of each of the signal wires S1 to S4 in the arrangement direction.

Transmission Characteristic

Figure 3:
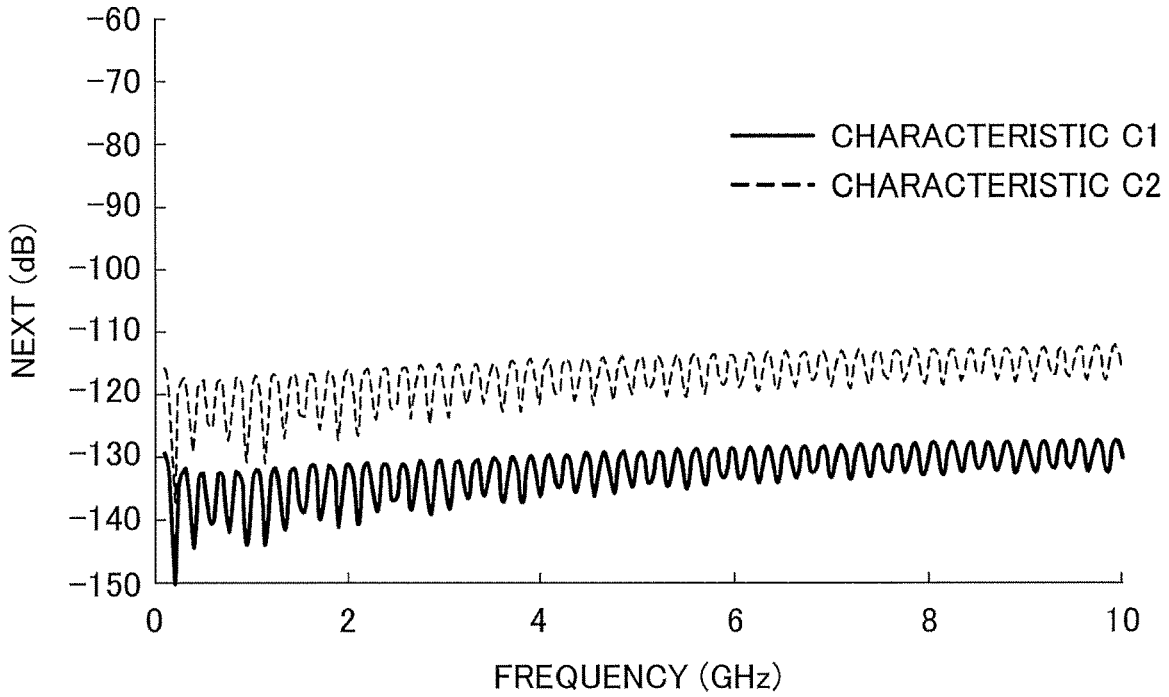
FIG. 3 is a drawing illustrating a characteristic of near-end crosstalk (NEXT) of a shielded flat cable.
Figure 4:
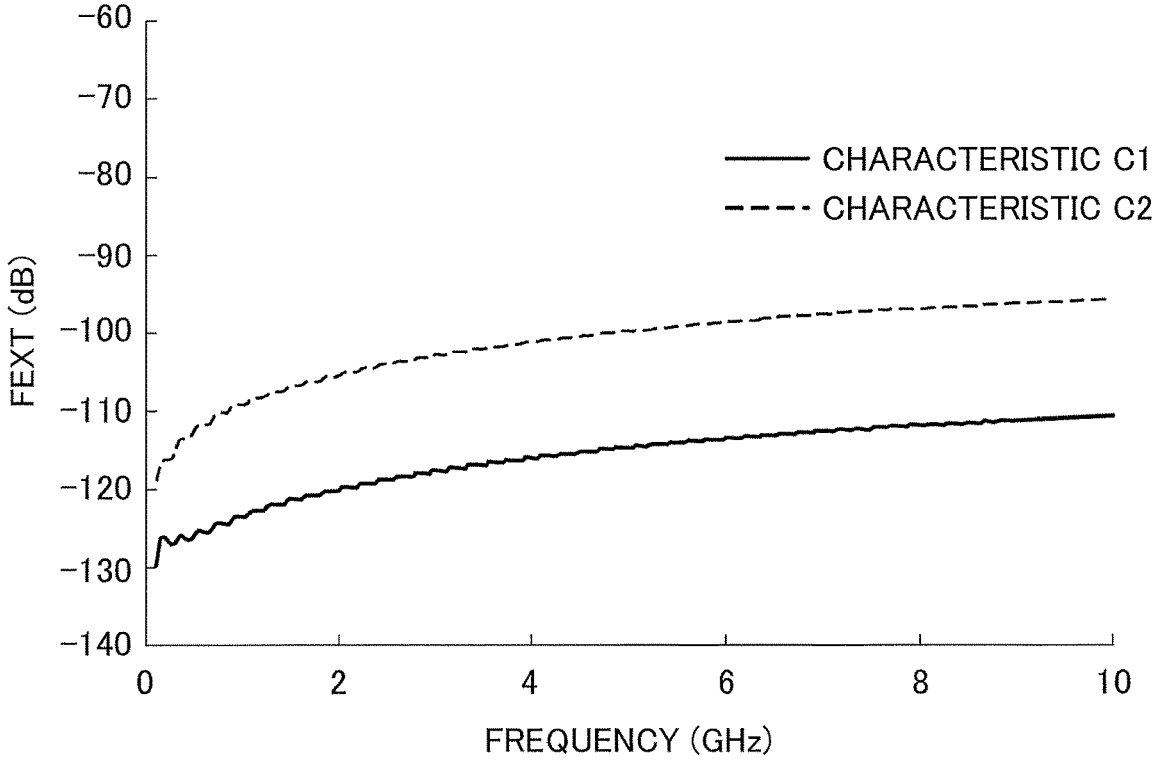
FIG. 4 is a drawing illustrating a characteristic of far-end crosstalk (FEXT) of a shielded flat cable.
Figure 5:
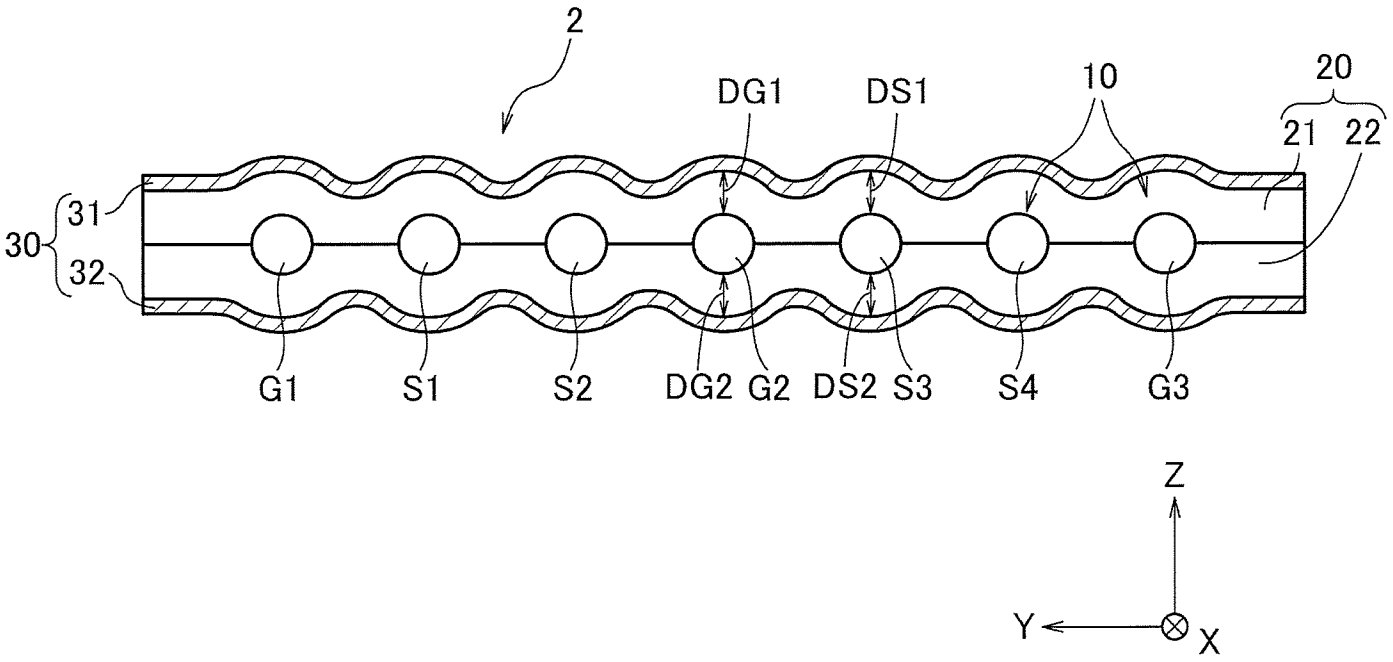
FIG. 5 is a cross-sectional view orthogonal to a longitudinal direction, illustrating an overview of a shielded flat cable that is a reference example of the present disclosure.

Next, a transmission characteristic of the shielded flat cable according to the present disclosure will be described. FIG. 3 is a drawing illustrating a characteristic of near-end crosstalk (NEXT) of the shielded flat cable, and FIG. 4 is a drawing illustrating a characteristic of far-end crosstalk (FEXT) of the shielded flat cable. FIG. 5 is a cross-sectional view orthogonal to the longitudinal direction, illustrating an overview of a shielded flat cable that is a reference example of the present disclosure.

A characteristic C1 illustrated in FIGS. 3 and 4 is a characteristic of the shielded flat cable 1 according to the present embodiment, and a characteristic C2 is a characteristic of a shielded flat cable 2 according to the reference example illustrated in FIG. 5. The shielded flat cable 1 according to the present embodiment and the shielded flat cable 2 according to the reference embodiment differ in that the shielded flat cable 1 according to the present embodiment uses AWG No. 32 for the ground wires G1 to G3 and AWG No. 34 for the signal wires S1 to S4, whereas the shielded flat cable 2 according to the reference embodiment uses AWG. No. 34 for the ground wires G1 to G3 and the signal wires S1 to S4. Thus, in the shielded flat cable 2 of the reference example, as illustrated in FIG. 5, with respect to the first insulating layer 21, the thickness DG1 at the central position of each of the ground wires G1 to G3 in the arrangement direction is equal to the thickness DS1 at the central position of each of the signal wires S1 to S4 in the arrangement direction. With respect to the second insulating layer 22, the thickness DG2 at the central position of each of the ground wires G1 to G3 in the arrangement direction is equal to the thickness DS2 at the central position of each of the signal wires S1 to S4 in the arrangement direction.

As illustrated in FIG. 3, the NEXT of the shielded flat cable 1 of the present embodiment is much smaller than the NEXT of the shielded flat cable 2 of the reference example in the frequency range from 0 to 10 GHz. Similarly, as illustrated in FIG. 4, the FEXT of the shielded flat cable 1 of the present embodiment is much smaller than the FEXT of the shielded flat cable 2 of the reference example in the frequency range from 0 to 10 GHz. Thus, in the present embodiment, an influence of the crosstalk of the shielded flat cable can be significantly reduced.

Second Embodiment

Figure 6:
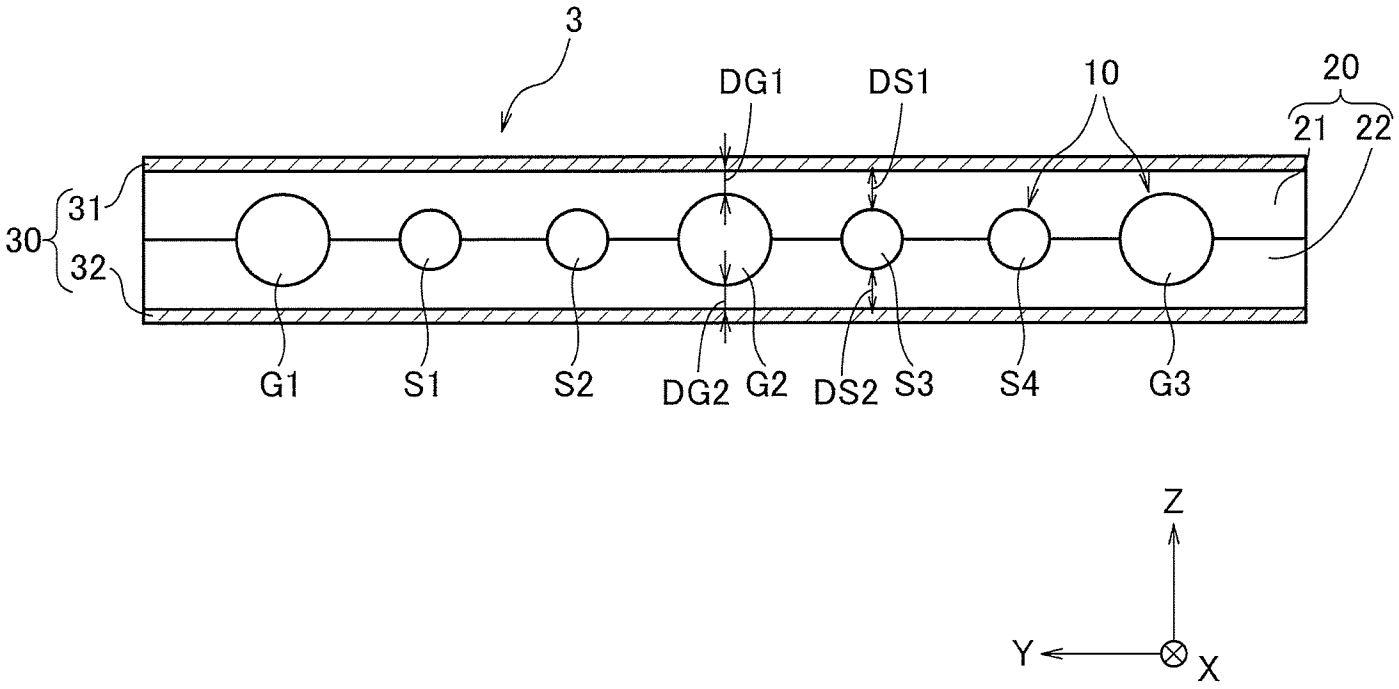
FIG. 6 is a cross-sectional view orthogonal to the longitudinal direction, illustrating an overview of a shielded flat cable according to a second embodiment of the present disclosure.

FIG. 6 is a cross-sectional view orthogonal to a longitudinal direction, illustrating an overview of a shielded flat cable according to a second embodiment of the present disclosure. As in the shielded flat cable 1 of the first embodiment, a shielded flat cable 3 includes the multiple conductors 10 arranged side by side parallel to each other, the first insulating layer 21 and the second insulating layer 22 that cover the conductors 10, the first shield layer 31 covering the outer surface of the first insulating layer 21, and the second shield layer 32 covering the outer surface of the second insulating layer 22. The shielded flat cable 3 according to the second embodiment differs from the shielded flat cable 1 according to the first embodiment in that the surfaces of the first insulating layer 21 and the second insulating layer 22 and the surfaces of the first shield layer 31 and the second shield layer 32 are flat.

In the shielded flat cable 3 of the present embodiment, the thickness of the ground wires G1 to G3 is greater than the thickness of the signal wires S1 to S4. Then, as illustrated in FIG. 6, in the cross-section orthogonal to the longitudinal direction, the thickness DG1 of the first insulating layer 21 at the central position of each of the ground wires G1 to G3 in the arrangement direction is smaller than the thickness DS1 of the first insulating layer 21 at the central position of each of the signal wires S1 to S4 in the assignment direction. The thickness DG2 of the second insulating layer 22 at the central position of each of the ground wires G1 to G3 in the arrangement direction is smaller than the thickness DS2 of the second insulating layer 22 at the central position of each of the signal wires S1 to S4 in the arrangement direction. Thereby, an effect similar to the shielded flat cable 1 according to the first embodiment can be obtained.

In manufacturing the shielded flat cable 2 according to the present embodiment, the heating rollers illustrated in FIG. 2 can be used. However, metal rollers having cylindrical surfaces are used as the heating rollers R11 and R12 at the first stage illustrated in FIG. 2. When the rubber rollers are used as the heating rollers R11 and the R12, since the rubber rollers are deformed, the first insulating layer 21 and the second insulating layer 22 can be deformed toward respective rubber roller sides at the positions of the conductors 10, and the surfaces are formed in wave shapes. However, when the metal rollers are used as the heating rollers R11 and R12, since the surface of the metal roller has high hardness, even when the first insulating layer 21 and the second insulating layer 22 are pressed between the heating rollers R11 and R12, the heating rollers R11 and R12 are not deformed. Therefore, the surfaces of the first insulating layer 21 and the second insulating layer 22 are formed in flat planes parallel to each other, as illustrated in FIG. 6.

Since the thickness of the ground wires G1 to G3 is greater than the thickness of the signal wires S1 to S4, in the shielded flat cable 3 according to the present embodiment, in the cross-section orthogonal to the longitudinal direction, the thickness of the first and second insulating layers 21 and 22 at the central position of each of the ground wires G1 to G3 in the arrangement direction is smaller than the thickness of the first and second insulating layers 21 and 22 at the central position of each of the signal wires S1 to S4 in the arrangement direction.

Third Embodiment

Figure 7:
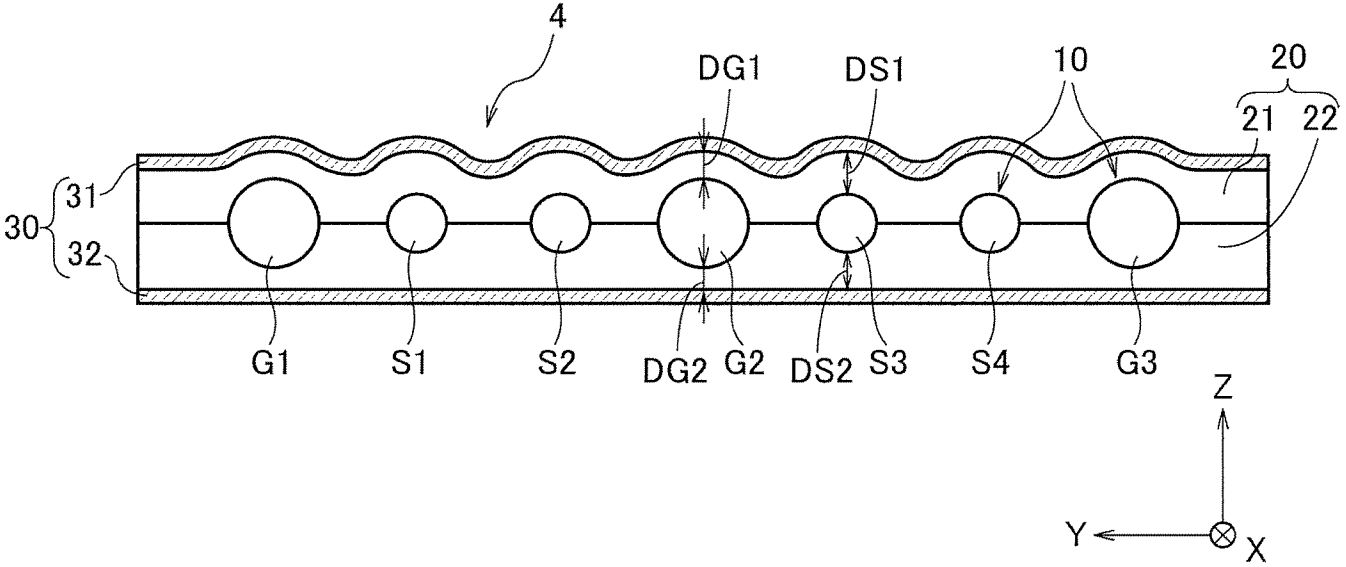
FIG. 7 is a cross-sectional view orthogonal to the longitudinal direction, illustrating an overview of a shielded flat cable according to a third embodiment of the present disclosure.

FIG. 7 is a cross-sectional view orthogonal to the longitudinal direction, illustrating an overview of a shielded flat cable according to a third embodiment of the present disclosure. As in the shielded flat cable 1 of the first embodiment, a shielded flat cable 4 includes the multiple conductors 10 arranged side by side parallel to each other, the first insulating layer 21 and the second insulating layer 22 that cover the conductors 10, the first shield layer 31 covering the outer surface of the first insulating layer 21, and the second shield layer 32 covering the second insulating layer 22. The shielded flat cable 4 according to the third embodiment differs from the shielded flat cable 1 according to the first embodiment in that the surfaces of the first insulating layer 21 and the first shield layer 31 are formed in wave shapes and the surfaces of the second insulating layer 22 and the second shield layer 32 are formed in planes.

In the shielded flat cable 4 of the present embodiment, the thickness of the ground wires G1 to G3 is greater than the thickness of the signal wires S1 to S4. As illustrated in FIG. 7, in the cross-section orthogonal to the longitudinal direction, the thickness DG1 of the first insulating layer 21 at the central position of each of the ground wires G1 to G3 in the arrangement direction is smaller than the thickness DS1 of the first insulating layer 21 at the central position of the signal wires S1 to S4 in the arrangement direction. The thickness DG2 of the second insulating layer 22 at the central position of each of the ground wires G1 to G3 in the arrangement direction is smaller than the thickness DS2 of the second insulating layer 22 at the central position of each of the signal wires S1 to S4 in the arrangement direction. Thereby, an effect similar to the effect of the shielded flat cable 1 according to the first embodiment can be obtained.

In manufacturing the shielded flat cable 4 according to the present embodiment, the heating rollers illustrated in FIG. 2 can be used. However, as the heating rollers R11 and R12 at the first stage of FIG. 2, a rubber roller having a cylindrical surface is used for the heating roller R11 disposed on a first insulating layer 21 side, and a metal roller having a cylindrical surface is used for the heating roller R12 disposed on a second insulating layer 22 side. Thus, the shape of the first insulating layer 21 of the shielded flat cable 4 becomes a wave shape similar to the shape of the first insulating layer 21 of the shielded flat cable 1 according to the first embodiment, and the shape of the second insulating layer 22 of the shielded flat cable 4 becomes a shape similar to the shape of the second insulating layer 22 of the shielded flat cable 3 according to the second embodiment.

Therefore, in the shielded flat cable 4 according to the present embodiment, in the cross-section orthogonal to the longitudinal direction, the thickness of the first and second insulating layers 21 and 22 at the central position of each of the ground wires G1 to G3 in the arrangement direction is smaller than the thickness of the first and second insulating layers 21 and 22 at the central position of each of the signal wires S1 to S4 in the arrangement direction.

Fourth Embodiment

Figure 8:
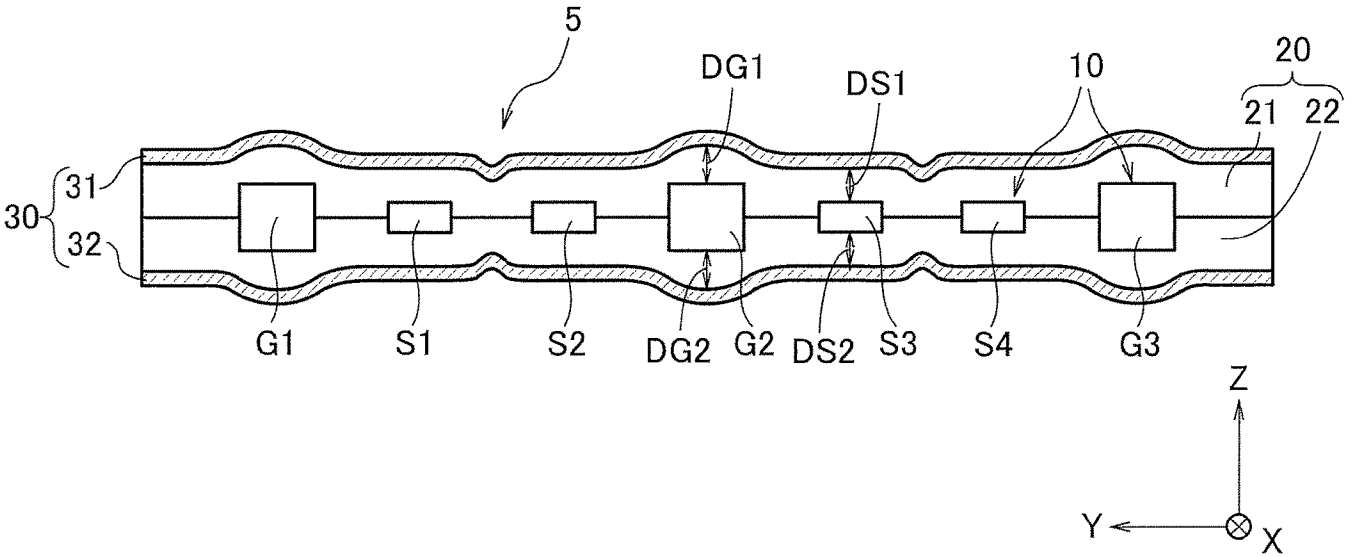
FIG. 8 is a cross-sectional view orthogonal to the longitudinal direction, illustrating an overview of a shielded flat cable according to a fourth embodiment of the present disclosure.

FIG. 8 is a cross-sectional view orthogonal to the longitudinal direction, illustrating an overview of a shielded flat cable according to a fourth embodiment of the present disclosure. As in the shielded flat cable 1 of the first embodiment, a shielded flat cable 5 includes the multiple conductors 10 arranged side by side parallel to each other, the first insulating layer 21 and the second insulating layer 22 that cover the conductors 10, the first shield layer 31 covering the outer surface of the first insulating layer 21, and the second shield layer 32 covering the outer surface of the second insulating layer 22. The shielded flat cable 5 according to the fourth embodiment differs from the shielded flat cable 1 according to the first embodiment in a cross-sectional shape of the conductor 10.

In the present embodiment, a flat conductor is used as the conductor 10. The signal wires S1 to S4, for example, are made of a conductive metal such as copper foil, tin-plated soft copper foil, and are flat conductors having the thickness from 10 to 100 μm and the width from about 0.2 to 0.8 mm. For the ground wires G1 to G3, flat conductors having a height higher than the signal wires S1 to S4 in a direction orthogonal to the arrangement direction (i.e., in the Z-axis direction), in the cross-section orthogonal to the longitudinal direction, are used. The conductors 10, which are the ground wires G1 to G2 and the signal wires S1 to S4, are arranged with pitches of a suitable length from about 0.4 to 2.0 mm.

As described, in the shielded flat cable 5 of the present embodiment, the height of the ground wires G1 to G3 in the direction orthogonal to the arrangement direction is higher than the height of the signal wires S1 to S4. As illustrated in FIG. 8, in the cross-section orthogonal to the longitudinal direction, the thickness DG1 of the first insulating layer 21 at the central position of each of the ground wires G1 to G3 in the arrangement direction is smaller than the thickness DS1 of the first insulating layer 21 at the central position of each of the signal wires S1 to S4 in the arrangement direction. The thickness DG2 of the second insulating layer 22 at the central position of each of the ground wires G1 to G3 in the arrangement direction is smaller than the thickness DS2 of the second insulating layer 22 at the central position of each of the signal wires S1 to S4 in the arrangement direction. Therefore, an effect similar to the shielded flat cable 1 according to the first embodiment can be obtained.

In manufacturing the shielded flat cable 5 according to the present embodiment, a method similar to the method for manufacturing the shielded flat cable 1 according to the first embodiment can be used. That is, as the heating rollers R11 and R12 at the first stage and the heating rollers R21 and R22 at the second stage, the rubber rollers having cylindrical surfaces are used. Thus, when the conductors 10 are sandwiched between the first insulating layer 21 and the second insulating layer 22 and the first insulating layer 21 and the second insulating layer 22 are bonded to the conductors 10, forces exerted on positions of the first insulating layer 21 and the second insulating layer 22 at the high ground wires G1 to G3 are greater than forces exerted on positions of the first insulating layer 21 and the second insulating layer 22 at the low signal wires S1 to S4. Therefore, as illustrated in FIG. 1, with respect to the thickness of the first insulating layer 21, the thickness DG1 at the central position of each of the ground wires G1 to G3 in the arrangement direction is smaller than the thickness at the central position of each of the signal wires S1 to S4 in the arrangement direction. Similarly, with respect to the thickness of the second insulating layer 22, the thickness DG2 at the central position of each of the ground wires G1 to G3 in the arrangement direction is smaller than the thickness DS2 at the central position of each of the signal wires S1 to S4. Further, since the rubber rollers are deformed, the first insulating layer 21 and the second insulating layer 22 can be deformed toward respective rubber roller sides at the positions of the conductors 10, and the surfaces are not to be flat.

Therefore, in the shielded flat cable 5 of the present embodiment, in the cross-section orthogonal to the longitudinal direction, the thickness of the first and second insulating layers 21 and 22 at the central position of each of the ground wires G1 to G3 in the arrangement direction is smaller than the thickness of the first and second insulating layers 21 and 22 at the central position of each of the signal wires S1 to S4 in the arrangement direction.

Fifth Embodiment

Figure 9:
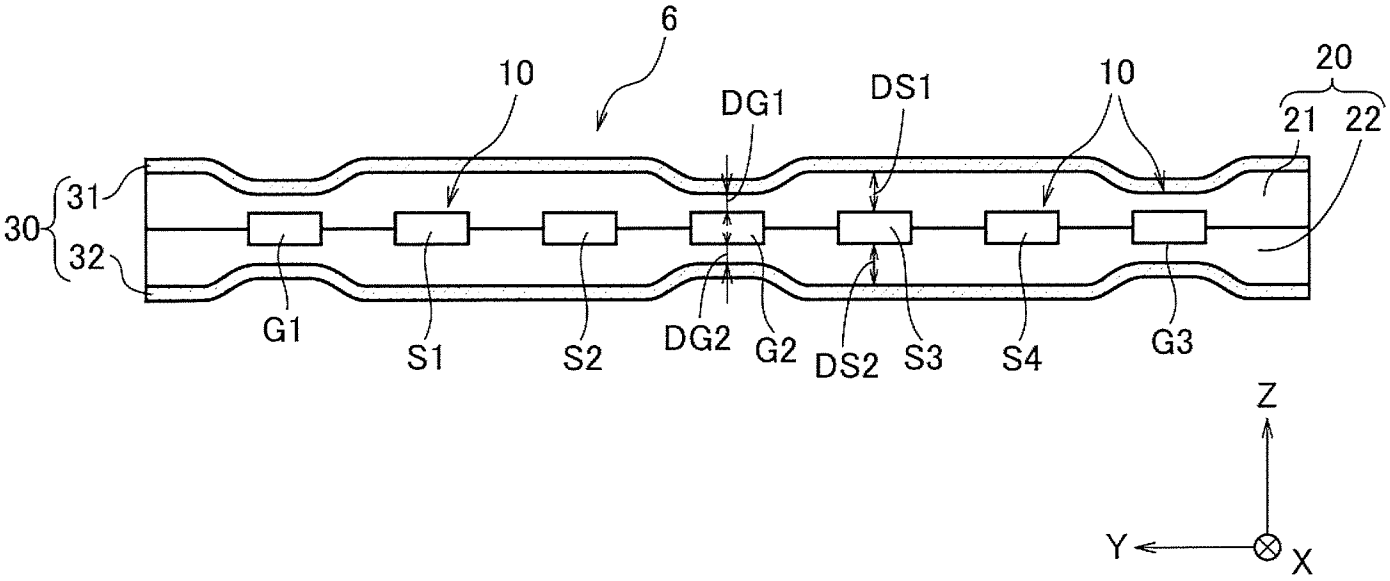
FIG. 9 is a cross-sectional view orthogonal to the longitudinal direction, illustrating an overview of a shielded flat cable according to a fifth embodiment of the present disclosure.

FIG. 9 is a cross-sectional view orthogonal to the longitudinal direction, illustrating an overview of a shielded flat cable according to a fifth embodiment of the present disclosure. As in the shielded flat cable 1 of the first embodiment, a shielded flat cable 6 according to the present embodiment includes the multiple conductors 10 arranged side by side parallel to each other, the first insulating layer 21 and the second insulating layer 22 that cover the conductors 10, the first shield layer 31 covering the outer surface of the first insulating layer 21, and the second shield layer 32 covering the outer surface of the second insulating layer 22. The shielded flat cable 6 of the present embodiment differs from the shielded flat cables of other embodiments in that conductors 10 having the same cross-sectional shape are used as the conductors 10, which are the ground wires G1 to G3 and the signal wires S1 to S4.

In the present embodiment, flat conductors having rectangular cross-sections are used as the conductors 10, which are the ground wires G1 to G3 and the signal wires S1 to S4. As illustrated in FIG. 9, in the cross-section orthogonal to the longitudinal direction, the thickness DG1 of the first insulating layer 21 at the central position of each of the ground wires G1 to G3 in the arrangement direction is smaller than the thickness DS1 of the first insulating layer 12 at the central position of each of the signal wires S1 to S4 in the arrangement direction. The thickness DG2 of the second insulating layer 22 at the central position of each of the ground wires G1 to G3 in the arrangement direction is smaller than the thickness DS2 of the second insulating layer 22 at the central position of each of the signal wires S1 to S4 in the arrangement direction. Therefore, an effect similar to the effect of the shielded flat cable 1 according to the first embodiment can be obtained.

In manufacturing the shielded flat cable 6 according to the present embodiment, the heating rollers illustrated in FIG. 2 can be used. In this case, as the heating rollers R11 and R12 at the first stage of FIG. 2, metal rollers whose surfaces have convex portions in a ring shape are used. The ring convex portions of the heating rollers R11 and R12 are disposed at positions where the ground wires G1 to G3 provided to the heating rollers R11 and R12 are positioned. Thus, the first insulating layer 21 and the second insulating layer 22 are recessed at positions where the ground wires G1 to G3 are positioned by being pressed between the heating rollers R11 and R12. Therefore, as illustrated in FIG. 9, with respect to the surface of the first insulating layer 21 and the second insulating layer 22, the thickness DG1 of the first insulating layer 21 at the central position of each of the ground wires G1 to G3 in the arrangement direction is smaller than the thickness DS1 of the first insulating layer 21 at the central position of each of the signal wires S1 to S4 in the arrangement direction, and the thickness DG2 of the second insulating layer 22 at the central position of each of the ground wires G1 to G3 in the arrangement direction is smaller than the thickness DS2 of the second insulating layer 22 at the central position of each of the signal wires S1 to S4 in the arrangement direction.

In manufacturing the shielded flat cable 6 according to the present embodiment, the shielded flat cable 6 may be manufactured using an extruder in addition to the heating rollers described in FIG. 2. In this case, the multiple conductors 10 are guided to be inserted into crossheads provided in the extruder, and molten insulating resin to be the first insulating layer 21 and the second insulating layer 22 is provided to outer areas of the conductors 10 to perform an extrusion coating.

As described, in the shielded flat cable 6 according to the present embodiment, in the cross-section orthogonal to the longitudinal direction, the thickness of the first and second insulating layers 21 and 22 at the central position of each of the ground wires G1 to G3 in the arrangement direction is smaller than the thickness the first and second insulating layers 21 and 22 at the central position of each of the signal wires S1 to S4 in the arrangement direction. In the present embodiment, conductors each having a rectangular cross-section are used as the conductors 10, but round wires each being of the same cross-sectional area may be used.

Description of the Reference Numerals

1 to 6 shielded flat cable
10 conductor
21 first insulating layer
22 second insulating layer
31 first shield layer
32 second shield layer
G1 to G3 ground wire
R11 to R22 heating roller
S1 to S4 signal wire

What is claimed is:

1. A shielded flat cable comprising:

one or more ground wires arranged, the ground wires being parallel to each other;

one or more signal wires arranged parallel to the one or more ground wires;

an insulating layer continuously covering the one or more ground wires and the one or more signal wires; and a shield layer provided on an outer surface of the insulating layer, wherein a thickness of the insulating layer between an outer surface of each ground wire and an inner surface of the shield layer at a central position of each ground wire in an arrangement direction is smaller than a thickness of the insulating layer between an outer surface of each signal wire and the inner surface of the shield layer at a central position of each signal wire in the arrangement direction, in a cross-section orthogonal to a longitudinal direction of the one or more ground wires, the arrangement direction being a direction in which the one or more ground wires and the one or more signal wires are arranged parallel to each other.

2. The shielded flat cable as claimed in claim 1, wherein a thickness of the one or more ground wires in a direction orthogonal to the arrangement direction is greater than a thickness of the one or more signal wires in the direction orthogonal to the arrangement direction, in the cross-section orthogonal to the longitudinal direction of the one or more ground wires.

3. The shielded flat cable as claimed in claim 1, wherein a width of the one or more ground wires in the arrangement direction is greater than a width of the one or more signal wires in the arrangement direction, in the cross-section orthogonal to the longitudinal direction of the one or more ground wires.

4. The shielded flat cable as claimed in claim 1, wherein the one or more ground wires are one or more first flat conductors and the one or more signal wires are one or more second flat conductors, and wherein, in the cross-section orthogonal to the longitudinal direction of the one or more ground wires, a thickness of each first flat conductor at the central position of each ground wire in the arrangement direction is greater than a thickness of each second flat conductor at the central position of each signal wire in the arrangement direction.

5. The shielded flat cable as claimed in claim 1, wherein the one or more ground wires are one or more first flat conductors and the one or more signal wires are one or more second flat conductors, and wherein the insulating layer is recessed at the central position of each ground wire in the arrangement direction.

* * * * *